US005707090A

United States Patent [19]

Sedley

[11] Patent Number: 5,707,090

[45] Date of Patent: Jan. 13, 1998

[54] MAGNETIC CARD-OPERATED DOOR CLOSURE

[76] Inventor: Bruce Samuel Sedley, 30 Broadway, Fifth Floor, Flat C, Mei Foo Sun Chuen, Kowloon, Hong Kong

[21] Appl. No.: 571,883

[22] PCT Filed: May 9, 1994

[86] PCT No.: PCT/GB94/00996

§ 371 Date: Jan. 11, 1996

§ 102(e) Date: Jan. 11, 1996

[87] PCT Pub. No.: WO95/02104

PCT Pub. Date: Jan. 19, 1995

[30] Foreign Application Priority Data

Jul. 9, 1993 [GB] United Kingdom ..... 9314326

[51] Int. Cl.[6] ..... E05C 1/12

[52] U.S. Cl. ..... 292/172; 292/142

[58] Field of Search ..... 292/336.3, 172, 292/244, 142; 70/278

[56] References Cited

U.S. PATENT DOCUMENTS

| | | | |
|---|---|---|---|
| 2,431,105 | 11/1947 | Brinson | 292/172 |
| 3,702,070 | 11/1972 | Gartner | 70/278 |
| 3,733,861 | 5/1973 | Lester | 70/278 X |
| 3,947,060 | 3/1976 | Zimmer et al. | 292/142 |
| 4,384,465 | 5/1983 | Muus | 292/172 X |
| 4,633,687 | 1/1987 | Fane | 70/278 X |
| 4,727,301 | 2/1988 | Fulks et al. | 70/278 X |
| 4,934,800 | 6/1990 | Choi | 292/336.3 X |
| 5,010,752 | 4/1991 | Lin | 70/278 X |
| 5,060,991 | 10/1991 | Davidian et al. | 292/172 |
| 5,265,452 | 11/1993 | Dawson et al. | 292/142 X |

FOREIGN PATENT DOCUMENTS

| | | | |
|---|---|---|---|
| 482588 | 4/1992 | Germany | 292/172 |
| WO 86/01360 | 2/1986 | WIPO | 70/278 |

*Primary Examiner*—Rodney M. Lindsey
*Attorney, Agent, or Firm*—Gunn, Lee & Miller, P.C.

[57] ABSTRACT

A magnetic code operated lock cylinder is releasably coupled to a shaft extending into a door. When the lock is unlocked a pinion gear is rotationally coupled to the shaft which shaft on rotation retracts a door latch. The gear is coupled by a toothed rack to a gear connected to a handle. The handle and rack are surface mounted on the door.

8 Claims, 9 Drawing Sheets

MAGNETIC CARD-OPERATED DOOR CLOSURE

The invention relates to magnetic card-operated door closures.

The invention relates more particularly to magnetic code operated cylindrical type locks normally associated at present with circular operating knobs which must be rotated to release a door latch. Generally a laterally open slot is provided in the coded cylinder to receive a magnetic coded card and the cylinder can incorporate a magnetic lock code that can be automatically changed when required by insertion of suitable code changing cards. Such lock cylinders are fully described for example in European Patent 0241323 and European Patent Application 90903620-4.

Cylindrical type lock sets have operating knobs on the centre line of the lockset and on each side of the door which are capable of separately retracting the door latch when one or other is rotated. In the most common lock functions, the knob on the inside of a door can retract the door latch without using a coded key, irrespective of the lock being locked or unlocked. Such locks are in common use especially in hotels, homes and offices where the door is required normally to be unlocked from the inside without using a coded card or key even though it is locked from the outside. There is a preference in some territories for door latches and bolts to be retracted by handles instead of circular knobs. This preference has now become a requirement in some new government regulations because knobs are more difficult to rotate especially by children, the aged and physically handicapped persons. It has already been proposed where desired to have operating handle shafts laterally displaced from a locking bolt shafts and to surface-mount gear mechanisms connecting between the handle shafts and the bolt shafts in DE-A-3 627 634 and FR-A-2 682 985. "Surface-mounted gear mechanisms" are generally understood to mean a gear mechanism that lies generally flat and against a surface where it is held and has no shafts or axles which enter into the surface or extend much, if at all, beyond the lateral dimensions of the mechanism component gears themselves.

It is an object of the present invention to provide handle operated door closures incorporating magnetic card-operated cylindrical type lockset mechanisms which can be mounted in standard door holes used for most cylindrical type locksets.

According to the invention there is provided a handle operable door closure including a magnetic code lock cylinder for coupling to a spindle which must be rotated to retract a door latch, the spindle being arranged to extend into the door with its rotational axis generally at right angles to the major surfaces of the door, a face plate arranged to be fixed to one of the major surfaces and to support a handle having a handle shaft rotatable about an axis laterally displaced from and parallel to the axis of the spindle, a surface mounted gear mechanism for connecting and rotating the spindle and the handle shaft together, and a cam plate and a clutch plate to drivingly connect the gear mechanism to the shaft on insertion of a coded magnetic card in the lock cylinder.

The gear mechanism preferably provides a mechanical advantage such that the lock shafts turn through a greater arc than the handle shafts.

The gear mechanism may comprise a toothed rack extending between the axes of the lock shafts and the handle shafts arranged to cooperate with circular gears mounted respectively on the lock shaft and on the handle shaft.

Handle operated door closures according to the invention will now be described by way of example with reference to the accompanying drawings in which.

Figure 1:
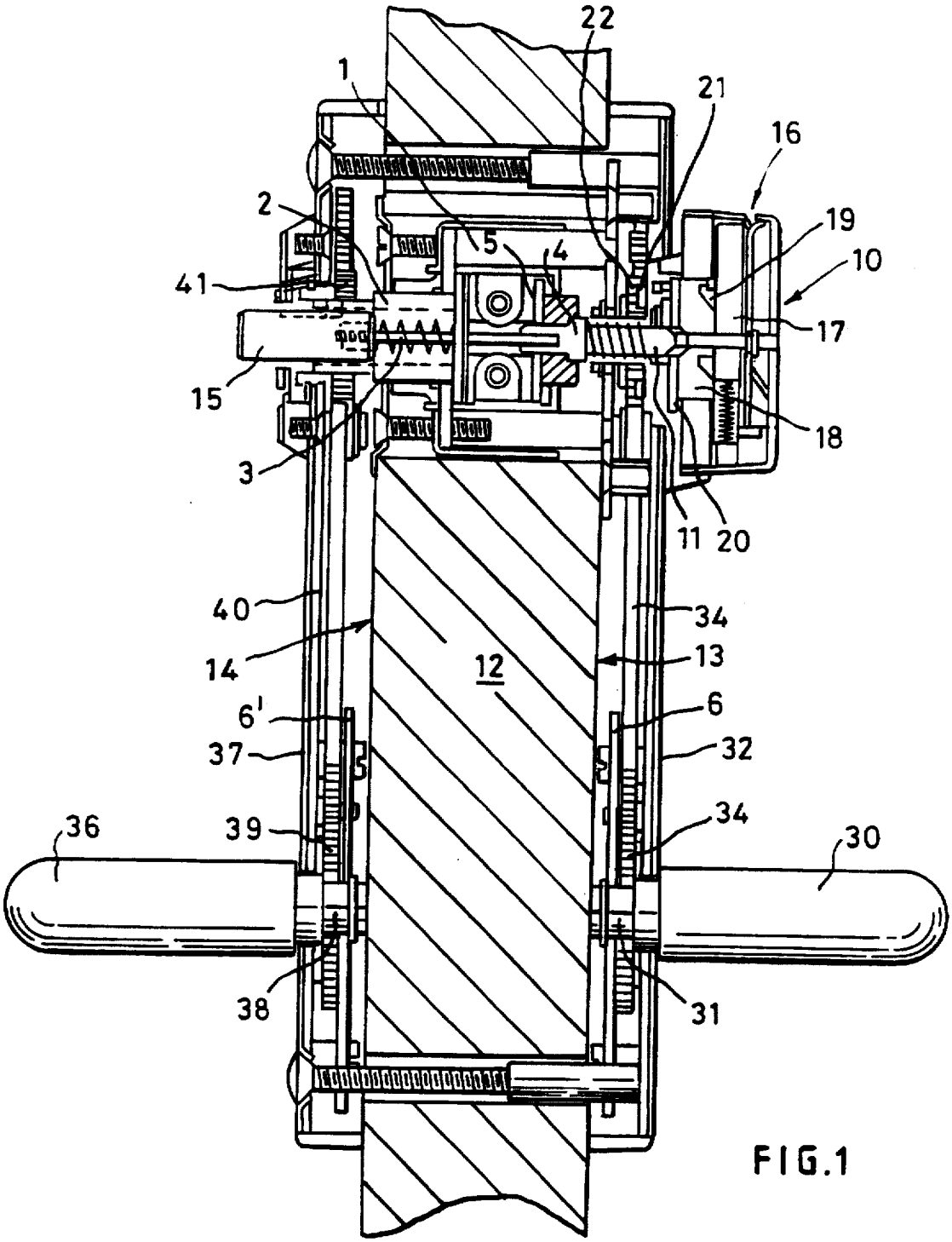
FIG. 1 is a partially cut-away side view of a door closure but not including a latch or dead bolt.

Referring to the drawings, in FIG. 1 a cylindrical type lock mechanism with a magnetic code operated cylinder 10 is releasably coupled to a shaft 11 extending into a door 12 at right angles to major surfaces 13 and 14 of the door. The cylinder 10 is accessible for operation outside of the door 12. A spindle 2 extends into the door from the inside surface 14 and is on the same rotational axis as the shaft 11. Rotation of either the shaft 11 or spindle 2 independently retracts door latch 44 (see in FIG. 4A). In one function the spindle 2 contains a push button 15 that may pressed into a lockable position to move a rod 3 causing the tip end of shaft 11 to block off the card slot 16 to prevent insertion of any card, except an "Emergency Key". This feature is fully explained in Europe Patent 0024242. In any event, when either of the shafts 11 or spindle 2 are turned through say about 90°, the door latch mechanically connected to these parts can be fully retracted to allow the door 12 to open. The shaft 11 and spindle 2 are both free to rotate but the shaft 11 will only be rotated if a card key having an appropriate magnetic code is inserted fully into the slot 16 of the lock cylinder 10, a slider 17 can be depressed then a cam plate 18 is pushed. When a correctly coded key is inserted in the slot 16 and the slider 17 depressed, a cam plate 18 is pushed to the left (as seen in FIG. 1) by bevelled cams 19 fixed to the slider 17. A clutch plate 20 is in turn pushed to the left and projections 21 engage in key ways of a pinion gear 22. As the clutch plate 20 is slidably connected to the shaft 11 which can rotate a spindle 4 which pulls back a latch retractor 5, rotation of the pinion gear 22 will retract the door latch 44.

In accordance with the present invention, a door handle 30 is provided and supported with a handle shaft 31 by a trim or face plate 32 fixed to the outside of the door 12. The shaft 31 is laterally displaced from and rotatable about an axis parallel to the shaft 11 and secured by a plate 6. A circular gear 33 is mounted on the shaft 31 and a toothed rack 34 extends between the gear 33 and the pinion gear 22. As a result, the door latch is retracted by operation of the door handle 30 provided that a correctly card is fully inserted in the slot 16 at the same time. Insertion of the card is required as explained above to drivingly connect the pinion Sear 22 to the shaft 11.

Another handle 36 is similarly arranged and supported by a trim or face plate 37 mounted on the inside of the door and has a handle shaft 38 secured by another plate 6'. A gear 39 is mounted on the shaft and toothed rack 40 extends up to and engages a pinion gear 41 fixed to the spindle 2.

The handle 36 is also used to retract the door latch but its operation differs from the operation of the handle 30 because the handle 36 is not dependent on the lock cylinder 10. In other words, a correctly coded card is not required to open the door 12 from the inside of the door because the gear 41 is always drivingly connected to the spindle 2.

It will be noted, or observed from other Figures of the drawings, that the racks 34 and 40 together with respective gears on the lock shafts, spindle and handle shafts are arranged so that when the handle is turned through an arc of say about 60°, the shafts 11 or spindle 2 are turned through arcs of about 90°. Thus, the surface mounted gear mechanisms provided as described produce a useful mechanical advantage. Generally, operation of a door handle by more than 60° to retract a door latch is not normally comfortable or convenient for the user. But as a greater rotation of the shaft 11 or spindle 2 is normally required by cylindrical type lock sets to retract a door latch, by having different effective radii as between the gears on the lock shafts 11 and spindle 2 and the handle shafts 31 and 38, a convenient and useful mechanical advantage is provided.

Figure 2A:
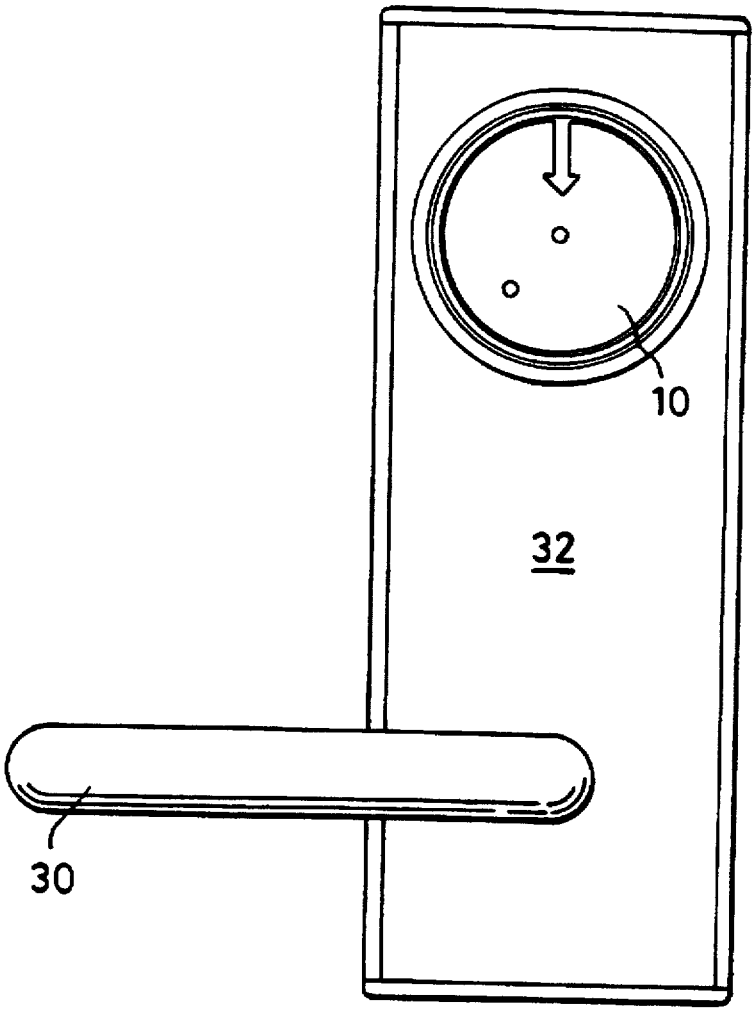
FIGS. 2A and 2B show respectively a front and side view of an outside trim plate assembly.
Figure 2B:
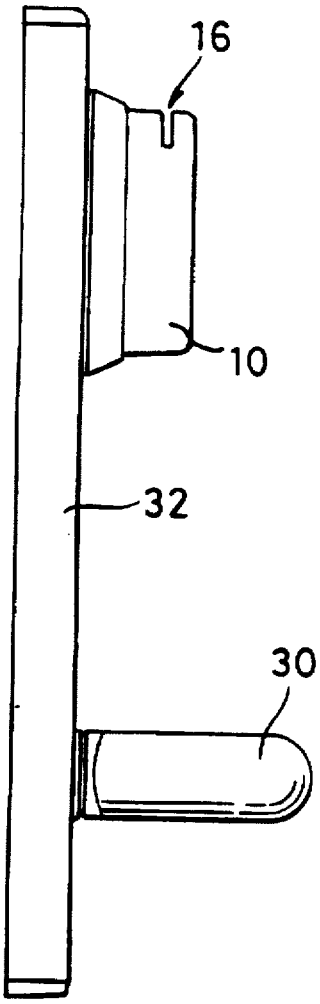

Referring to FIGS. 2A and 2B, the trim plate 32 extends up and beyond the lock cylinder 10 and covers the surface mounted rack 34 (FIG. 1). The handle 30 is supported by the trim plate 32 (as explained earlier) and it will be appreciated that, with minimum changes or extra requirements for the door (only extra holes for trim plate fixing are required), the handle, trim plate and rack can be fitted into standard cylindrical lock set door holes.

It will be noted that where appropriate or preferred the door latch may be retracted by a knob fitted to the spindle 2. In other words, the handle 36, the rack 40 and trim plate 37 need not always be provided.

Figure 3A:
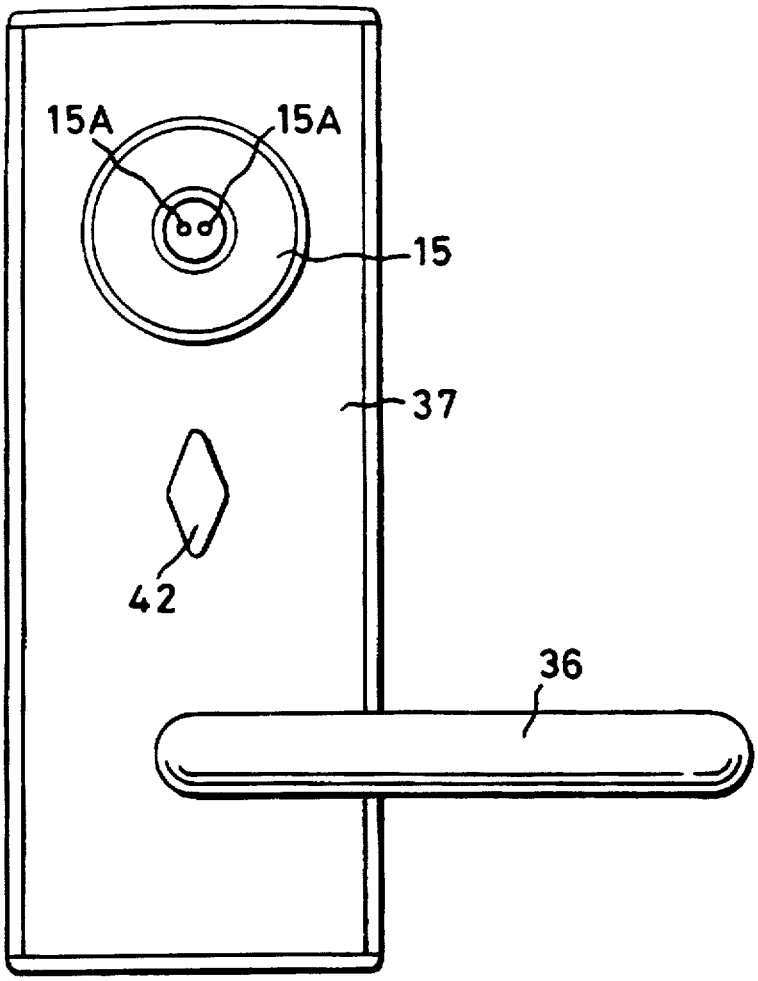
FIGS. 3A and 3B show respectively a front and side view of an inside trim plate assembly.
Figure 3B:
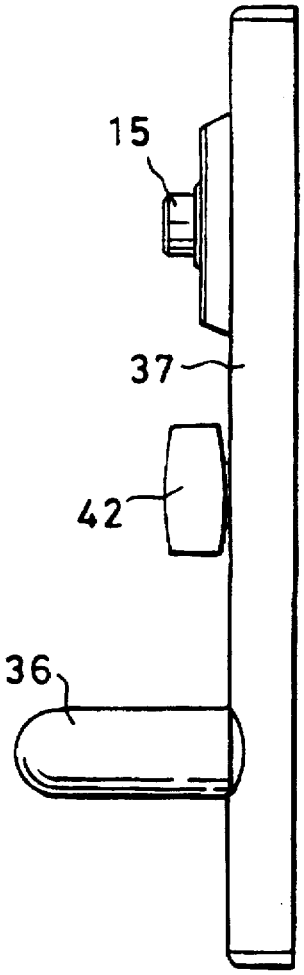

However, in the embodiment as seen in FIG. 3A and 3B the trim plate 37 for the inside of the door contains a dead bolt operating knob 42. The knob can be manually turned when required to urge a dead bolt (not shown) into and out of a door jam as required in a generally conventional manner.

Figure 4A:
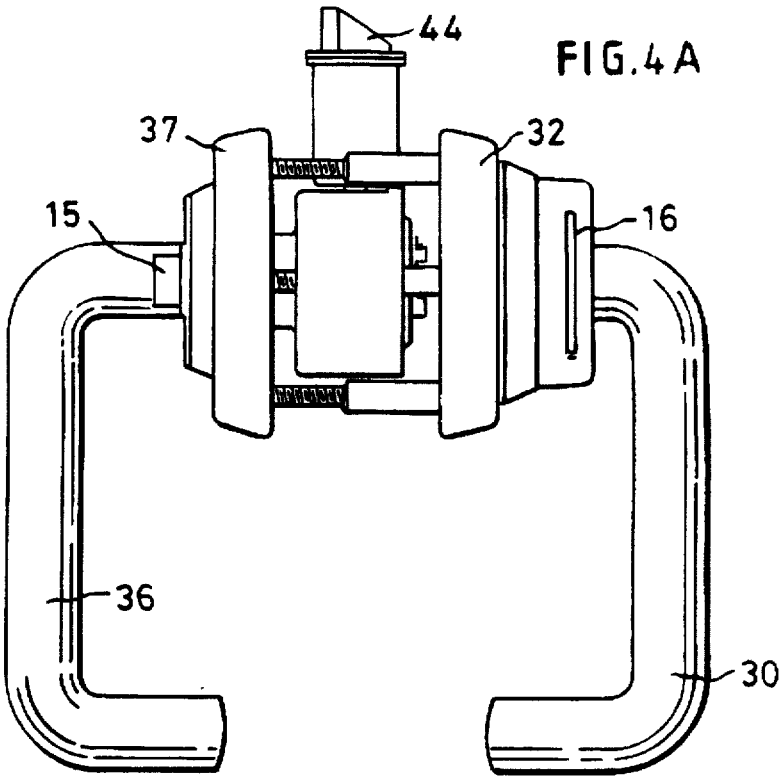
FIGS. 4A and 4B show respectively a top view of the door closure with a latch and a rear side view.
Figure 4B:
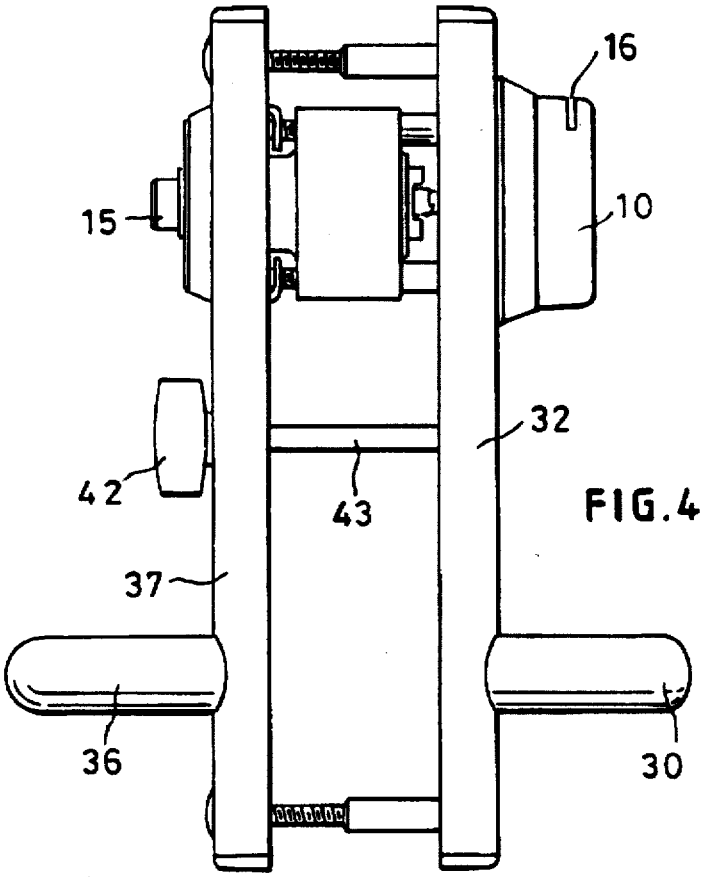

In FIGS. 4A and 4B, the drawings show the complete door closure as it would be assembled when fixed to a door. A shaft 43 of the dead bolt mechanism and the door latch 44 are clearly shown in these Figures.

Figures 5A, 5B, 5C:
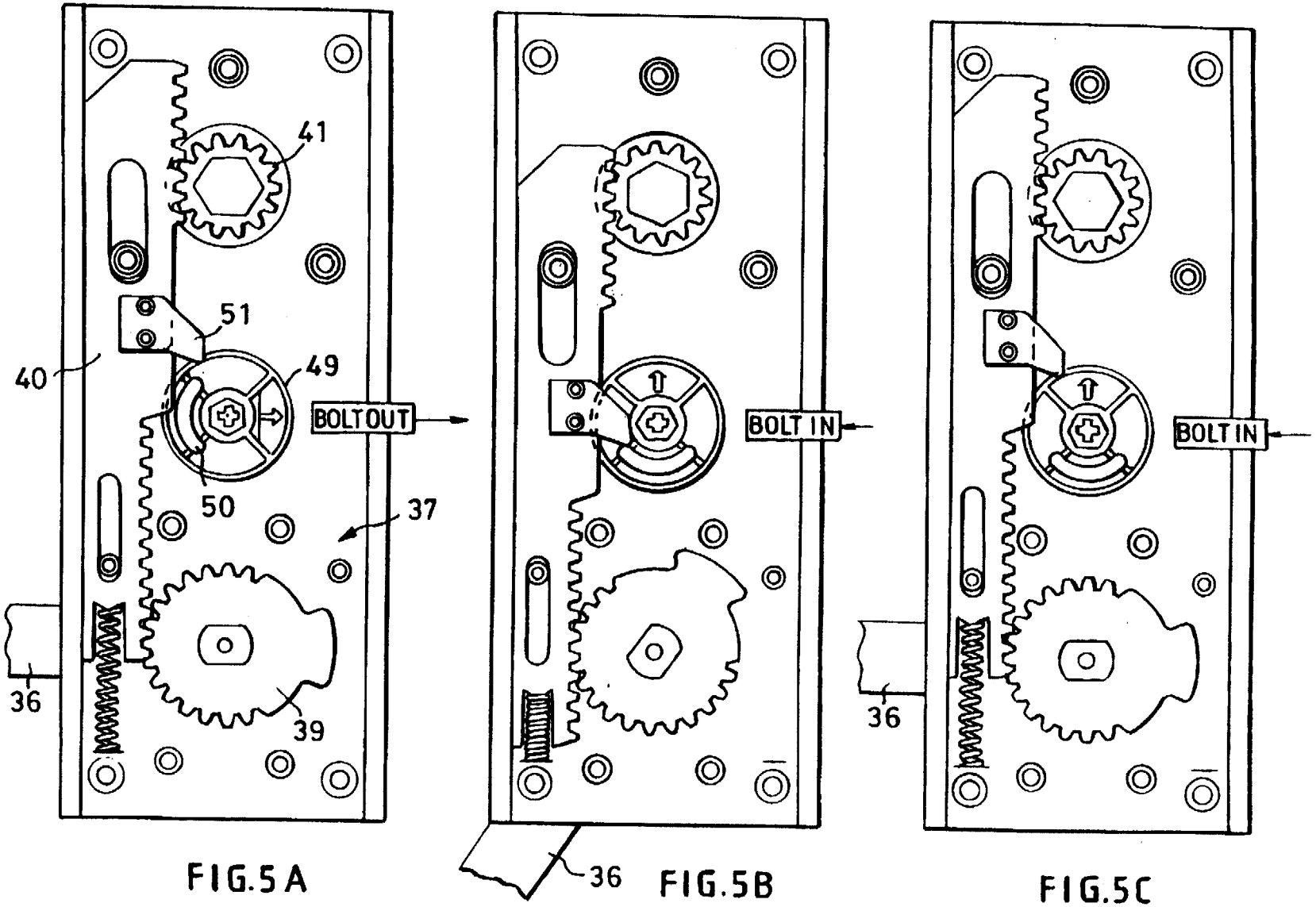
FIGS. 5A, 5B and 5C show different inside views of the inside trim plate assembly of the door closure.

In FIGS. 5A, 5B and 5C, inside the trim plate 37, the gears 39 and 41 are clearly shown and, as mentioned earlier it will be noted that the effective radius of the gear 41 is smaller than the effective radius of the gear 39. A wheel 49 is mounted on the dead bolt operating shaft 43 (see FIG. 4B). A cam 50 is mounted to the wheel 49. A finger 51 is fixed to and moves up and down with the rack 40.

In FIG. 5A, the dead bolt (not shown) is OUT, that is the bolt extends into the door jam and so it will be necessary to retract the bolt before the door can open. FIG. 5B shows the position of the parts when the handle 36 is normally depressed and it will be seen that the finger 51 has moved downwards and in so doing has engaged against and pushed the cam 50. In consequence, the wheel 49 has been turned through a 90°arc. This action retracts the dead bolt out of the door jam as required and so, in order to open the door from the inside, when the handle 36 is operated it simultaneously moves the extended dead bolt and retracts the door latch. In FIGS. 5C, the dead bolt is IN that is in the non-locking position and it will be observed that the rack 40, and the finger 51, can move up and down without altering the position of the wheel 49.

Figure 6C:
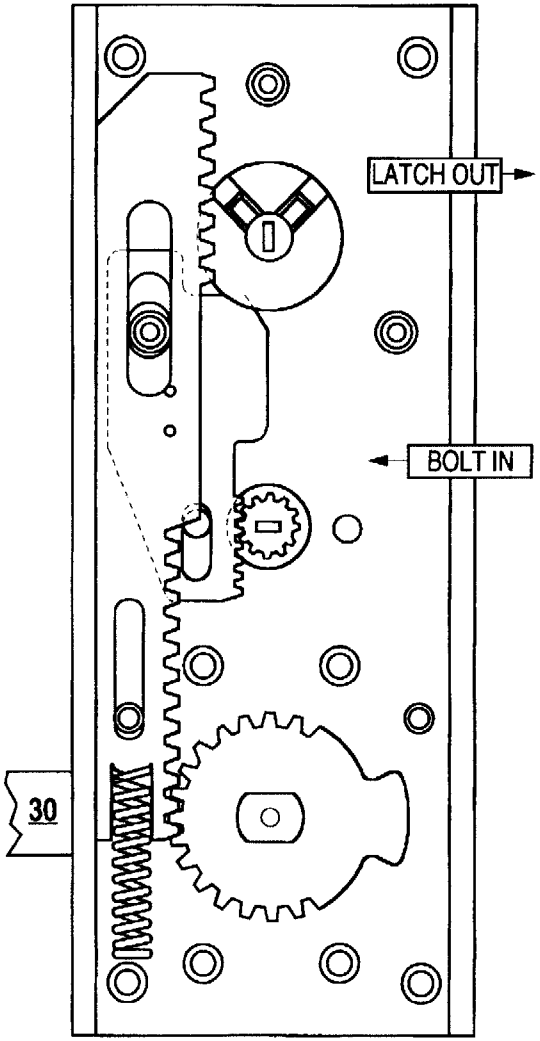
FIGS. 6A, 6B and 6C show different inside views of the outside trim plate assembly.
Figure 6B:
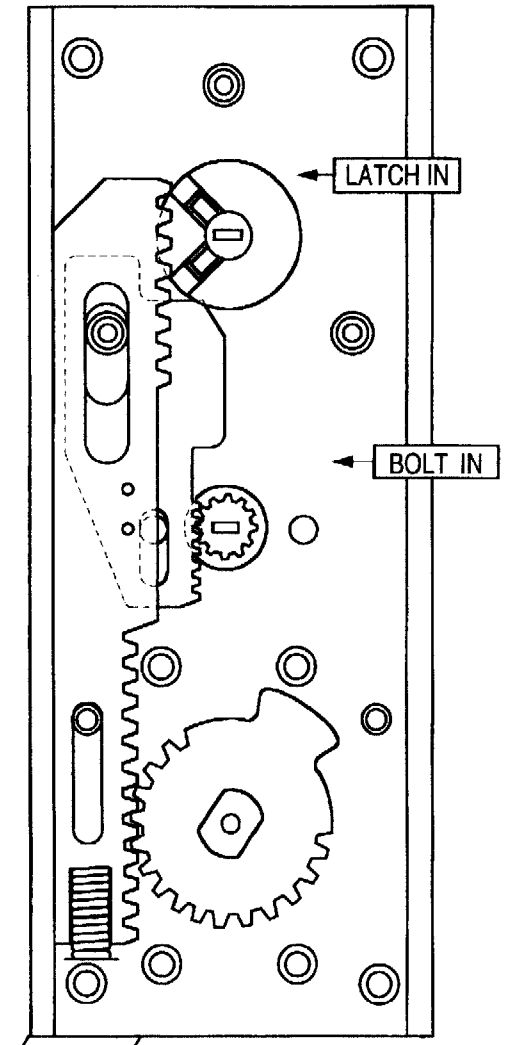
Figure 6A:
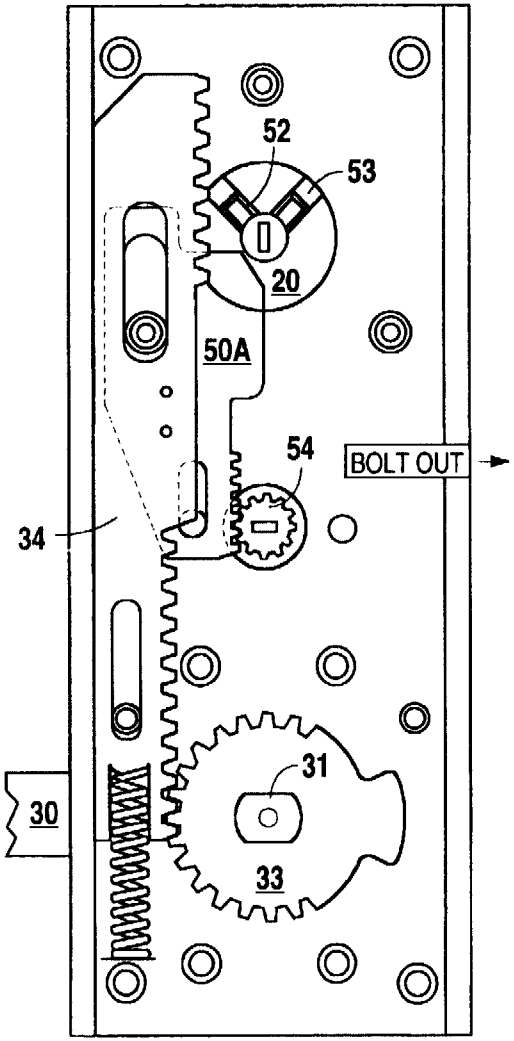

In FIGS. 6A, 6B and 6C, above the inside surface of the outside trim plate 32 is mounted the rack 34 and below it a shorter additional rack 50A. For clarity the pinion gear 22 is not shown. A clutch plate 20 has two stepped keys 52 and 53 in a V-shaped configuration. The shorter parts of each step engage with a groove in a side surface of the gear 22 and the longer parts extend to the peripheral edges of the clutch plate 20 but pass to the side of the rack 34 to contact a top edge of the short rack 50 when required. As a result as seen in FIG. 6B, one longer part pushes the short rack 50A downwards and so rotates a gear 54 mounted on the dead bolt shaft 43 (see FIG. 4B). It will be noted that there are two stepped keys 52 and 53 although only one is required. This is so that the same part 20 may be used for a left-handed operation and a right-handed operation when in practice the clutch plate 20 will be moved clockwise in the one and anti-clockwise in the other. In any event, operation of the handle 30, when a suitable coded card is also inserted in the slot 16, causes an extended dead bolt to be retracted IN, out of the door jam. This is shown by comparing the FIGS. 6A and 6B.

If the dead bolt is IN, the rack 50 is in the position shown in FIG. 6C and so when the clutch plate 20 is turned by operating the handle 30, the longer part of the keys 52 or 53 does not press on the top of the rack 50 to cause the shaft 43 to be rotated.

Figure 7B:
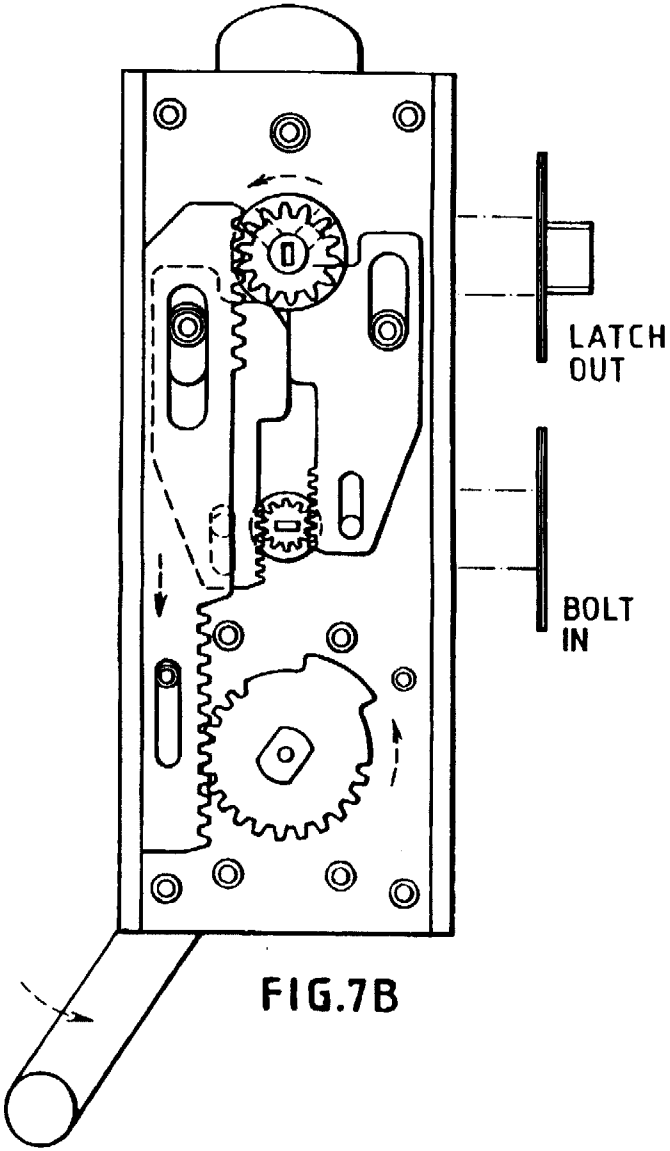
FIGS. 7A, 7B, 7C, 7D and 7E shows different views of a coupled latch and dead bolt.
Figure 7A:
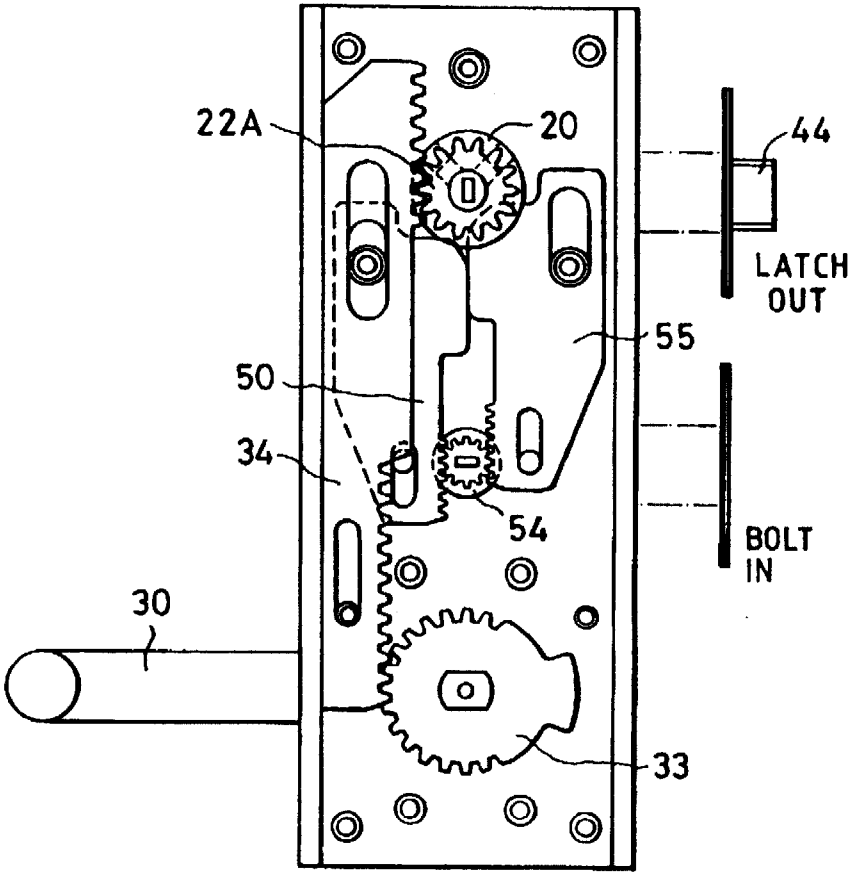

In FIGS. 7A, 7B, 7C, 7D and 7E it will be noted the arrangement is the same as shown in FIG. 6A except there is an additional short rack 55. This is incorporated, where desired, to operate the dead bolt to extend it into the door jam using the outside handle 30. The clutch plate 20 has the same two stepped keys but gear 22A has four cooperating grooves; again four are provided to make the part 22A suitable for left and right-handed operation. Gear 22A, and rack 55 are for use in locks for a residence or office areas to be able to leave the door not only latched but dead bolted from the outside. This is achieved as follows, the FIG. 7A to 7E are taken in sequence:

Starting at FIG. 7A, the door latch is extended and the bolt retracted and the handle 30 is at rest and horizontal. This is the normal mode of the lock when the dead bolt is not extended into the door jam. The handle 30 is then pushed down to the end of its travel (see FIG. 7B). This does not retract the door latch as it is not drivingly connected to the handle because the card has not been inserted. However gear 22A has been rotated about 90°degrees. Inserting a card now with the handle down causes the clutch plate 20 to engage into the mating pair of grooves in gear 22A.

Figure 7D:
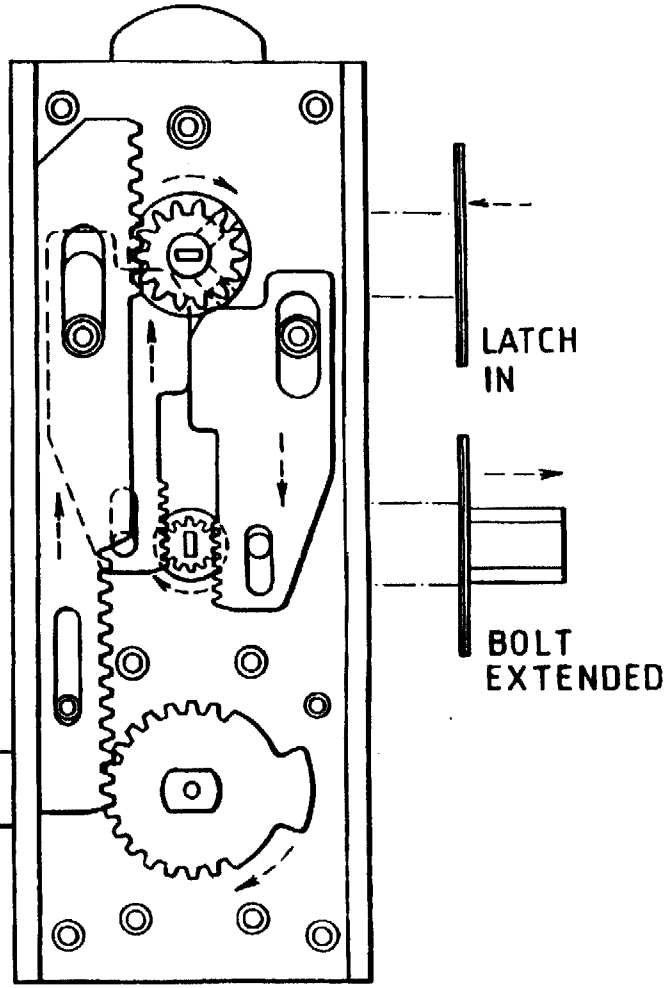
Figure 7C:
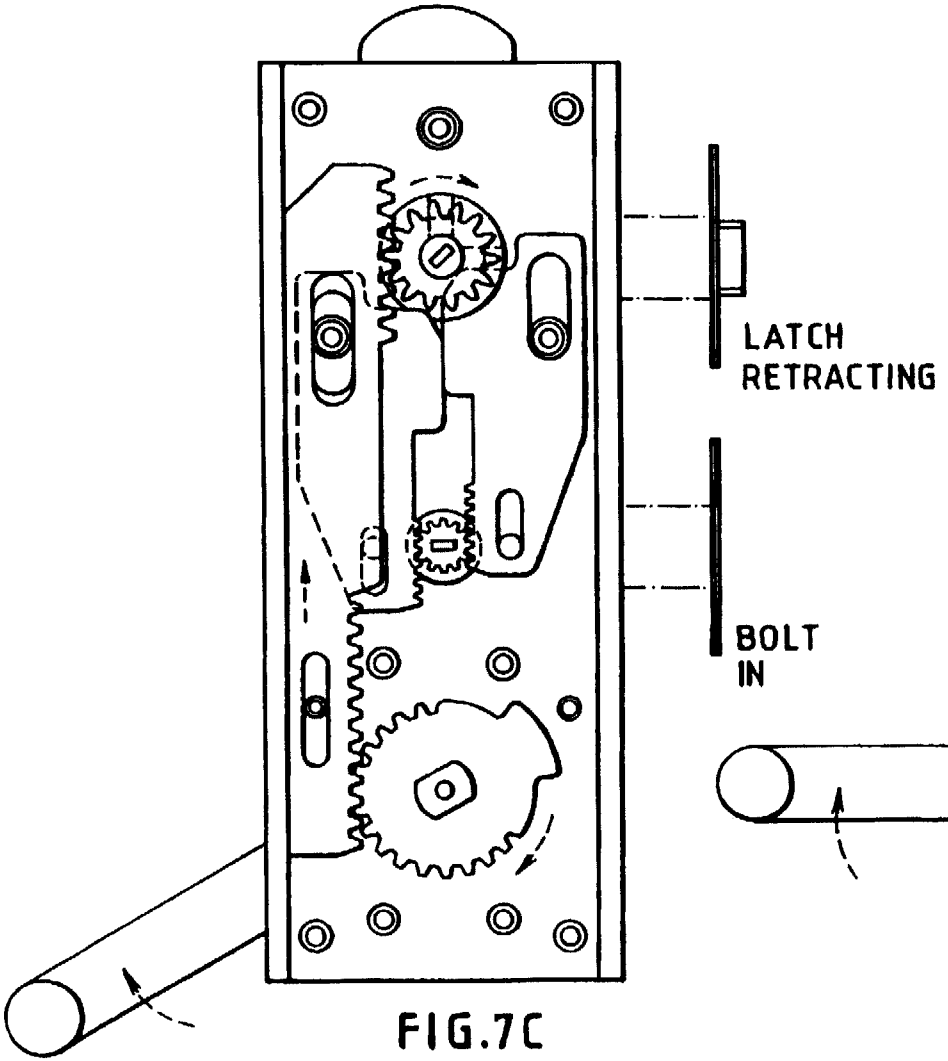
Figure 7E:
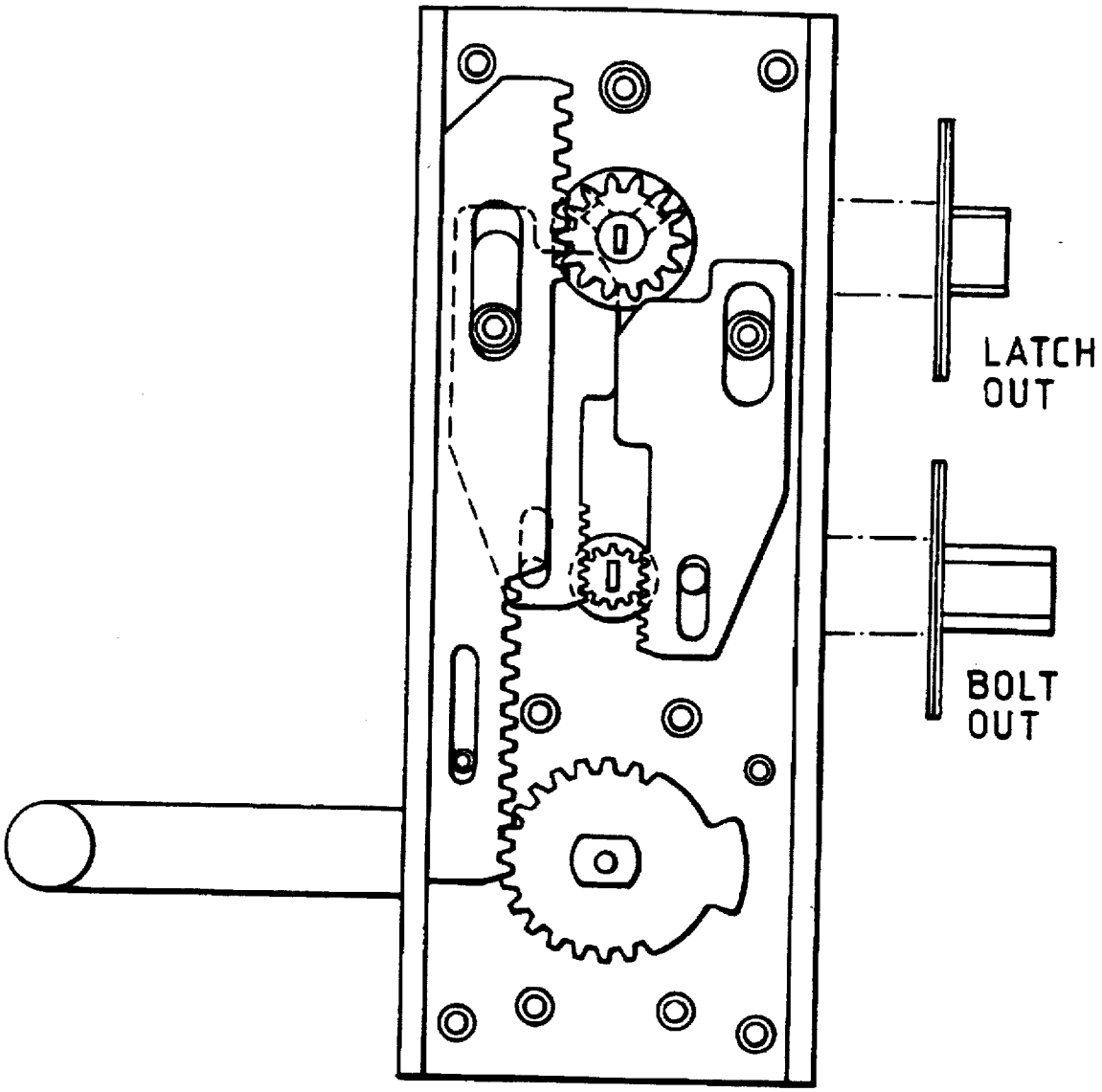

FIG. 7C shows the start of raising the handle 30 back to horizontal position. The latch 44 starts to retract as the clutch plate 20 is rotated in the opposite direction from normal. (The door latch will retract if the latch retractor 5 is pulled back by means of either a clockwise or an anti-clockwise rotation of the shaft 11). A clutch plate 20 step is now starting to press on the top of the rack 55 and continued pressure pushes the rack downwards. This causes dead bolt shaft 43 to be rotated which extends bolt 45. When the handle reaches horizontal the latch is fully retracted and the bolt is extended (FIG. 7D).

The card is then removed from the card slot, the clutch plate 20 is pushed out of engagement with the gear 22A by a biassing spring (not shown). The latch 44 springs back to its extended position as retractor springs (not shown) force the door latch retractor back to its normal position. This rotates the shaft 11 which rotates the clutch plate 20 back to its normal position to complete the locking sequence.

It will be noted that this dead bolt action could be used in a closure without a door latch and so much of the cylindrical lock mechanism would not be required.

It will be noted that the handle 30 and 36 are not on the same shaft and so excessive opposing forces on the handle cannot strain a common shaft. Also such excessive forces cannot be transferred to the lock mechanism to damage it.

The lock cylinder 10 can be mounted with the slot 16 uppermost as shown in the Figures, or lowermost or the side, as preferred for easy access of the card and to reduce any tendency of dirt or water to enter into the slot as may be otherwise possible in some locations.

For hotel locks especially, the push button 15 in the inside trim plate can be pushed in to block the card slot. However, turning the inside handle will automatically cause the release of the push button. Also if the door is opened and then the push button depressed, the closing of the door depresses the latch which causes the push button to be released. These functions prevent a person from locking himself outside the door with the card slot blocked.

Two holes 15A (see FIG. 3A) in the push button 15 allow a spanner key (not shown) to be inserted so that the button can be depressed and then rotated 90 degrees at which point the button will lock in the depressed position so that turning the inside handle or depressing the latch will not release the push button. The lock can then only be unlocked with an "Emergency Card Key".

The hand (left or right hand) of the lock can be changed by removing the long racks 34 and 40, rotating the handles 180 degrees and replacing the racks on the opposite side of the trim plates. Stops (not shown), which prevent the handle from being raised past horizontal or below 60° degrees, are provided in the rear plates 6 and 6' and inside the trim plates 32 and 37.

To prevent the push button being easily turned into the lock position by a guest, a friction sleeve (not shown) fits over the push button 15 and is prevented from rotating inside the spindle 2. This sleeve is tight enough to prevent the button from being turned by a finger, but it can be turned by an inserted spanner key.

A "Classroom" function may be provided and uses a special coded card, a so-called "SET" card. When this card is inserted into the card slot and pressed down it can be removed leaving the card lock UNLOCKED. Depressing the front handle will unlock the lock. This mode will remain until a properly coded card (a "RELEASE" card) is inserted which releases the lock so it will return to a locked mode when the card is removed. A single card is available where the "SET" code is on one side of the card and the "RELEASE" code on the reverse. Other cards can be coded provide a RELEASE function so that the first insertion of such a card will change the function of the lock back to Card-Only operation.

The described door closures may be provided with electrical contacts mounted on appropriate relatively movable parts which are arranged to close whenever, say, the door lock is unlocked by a coded card. The electrical contacts can be connected for example to initiate audible alarms, actuate electric door release devices or turn on indicator lights.

The described card lock cylinder 10 may be replaced where desired with other lock cylinders and in particular those having an automatic code changing facility in association with insertion of a code changing card. Also it will be appreciated that a lock cylinder may be mounted on the inside of the door and the push button 15 mounted on the outside of a door. Also a lock cylinder could be mounted on the inside of the door instead of the push button. In the latter case a coded card will be required to unlock the door from both inside the door and outside the door.

I claim:

1. A handle operable door closure including a magnetic code lock cylinder of a lock for receiving a magnetically coded card and a rotatable first shaft, said lock cylinder for coupling to said rotatable first shaft which retracts a door latch, said first shaft being arranged to extend into a door having two parallel major surfaces, said first shaft having a rotational axis for being generally at right angles to said major surfaces, a surface mounted face plate arranged to be fixed to one of said major surfaces and to support a handle, the improvement comprising:

a handle shaft rotatable about an axis laterally displaced from and parallel to said axis of said first shaft;

a gear mechanism mounted behind said face plate; said handle shaft engageable by said gear mechanism; and a cam plate for engagement by said card upon its insertion into said lock cylinder and a clutch plate for engagement by said cam plate, to drivingly connect said gear mechanism to said first shaft to rotate said first shaft only when said magnetic lock cylinder has been placed in an unlocked condition established by insertion of said magnetically coded card into said lock cylinder.

2. The improvement of claim 1 further comprising: a pinion gear in said gear mechanism encircling said first shaft; and said cam plate and said clutch plate axially movable on insertion of said magnetically coded card to drivingly connect said pinion gear to said first shaft.

3. The improvement of claim 1 further comprising: a spindle having an axis of rotation on said rotational axis of said first shaft and arranged such that rotation of said first shaft and said spindle independently retract said door latch.

4. The improvement of claim 3 further comprising: a second surface mounted face plate to be fixed on the other of said major surfaces of said door to support a second handle having a second shaft at one end rotatable about an axis laterally displaced from and parallel to the axis of a second spindle, and a second gear mechanism mounted in said second surface mounted face plate for connecting and rotating the second shaft of the second handle and the second spindle together to independently retract said door latch.

5. The improvement of claim 1 further comprising: a dead bolt mechanism having a dead bolt and a deal bolt rotatable shaft for extending and retracting said dead bolt on rotation thereof, a dead bolt gear mounted on said dead bolt rotatable shaft, and a dead bolt gear mechanism for connecting to and rotating said dead bolt gear.

6. The improvement of claim 5 wherein said dead bolt gear mechanism further comprises a dead bolt toothed rack mounted adjacent a toothed rack of said first gear mechanism.

7. The improvement of claim 5 wherein said dead bolt gear mechanism includes said clutch plate formed with at least one stepped key comprising a short leg and a stepped long leg, said short leg being arranged to fit into a respective radially extending groove in a side of a pinion gear when said clutch plate is axially pressed against said pinion gear and arranged such that said dead bolt toothed rack rotates said dead bolt gear by being pushed by and out of a path of said longer leg of said stepped key when said clutch plate is rotated by said pinion gear.

8. The improvement of claim 6 further comprising: a second dead bolt rack connectable to rotate said dead bolt gear in an opposite direction to a direction caused by operation of said dead bolt rack when said handle is depressed from a rest position and a magnetically coded card is inserted, return of said handle to its rest position causing said dead bolt to be extended.

* * * * *